United States Patent [19]

Kumasaka et al.

[11] Patent Number: 4,998,143

[45] Date of Patent: Mar. 5, 1991

[54] ELECTROPHOTOGRAPHIC IMAGE TRANSFER MEMBER, ELECTROPHOTOGRAPHIC IMAGE TRANSFER DEVICE AND ELECTROPHOTOGRAPHIC RECORDING APPARATUS

[75] Inventors: Takao Kumasaka, Takahagi; Yuzuru Simazaki, Hitachi; Akira Terakado, Hitachi; Yasuro Hori, Katsuta, all of Japan

[73] Assignees: Hitachi, Ltd.; Hitachi Koki Co., Ltd., both of Tokyo, Japan

[21] Appl. No.: 407,870

[22] Filed: Sep. 15, 1989

[30] Foreign Application Priority Data

| | | | |
|---|---|---|---|
| Sep. 20, 1988 | [JP] | Japan | 63-233539 |
| Oct. 19, 1988 | [JP] | Japan | 63-261532 |
| May 10, 1989 | [JP] | Japan | 1-114959 |

[51] Int. Cl.[5] ..... G03G 15/01; G03G 15/16

[52] U.S. Cl. ..... 355/271; 355/326

[58] Field of Search ..... 355/271, 272, 326, 327, 355/217

[56] References Cited

U.S. PATENT DOCUMENTS

| | | | |
|---|---|---|---|
| 2,807,233 | 9/1957 | Fitch . | |
| 3,691,993 | 9/1972 | Krause et al. . | |
| 3,751,156 | 8/1973 | Szostak et al. . | |
| 3,781,105 | 12/1973 | Meagher . | |
| 3,847,119 | 11/1974 | Hoffman et al. . | |
| 3,907,421 | 9/1975 | Jordan et al. . | |
| 3,936,170 | 2/1976 | Shibano et al. . | |
| 3,959,573 | 5/1976 | Eddy et al. . | |
| 3,959,574 | 5/1976 | Seanor et al. . | |
| 3,993,021 | 11/1976 | Kline . | |
| 4,309,803 | 1/1982 | Blaszak . | |
| 4,382,673 | 5/1983 | Nakajima et al. | 355/274 |
| 4,531,825 | 7/1985 | Miwa et al. | 355/271 X |
| 4,588,279 | 5/1986 | Fukuchi et al. | 355/271 |

FOREIGN PATENT DOCUMENTS

| | | | |
|---|---|---|---|
| 58-159556 | 10/1958 | Japan . | |
| 52-33494 | 8/1977 | Japan . | |
| 53-77533 | 10/1978 | Japan . | |
| 53-129338 | 10/1978 | Japan . | |
| 58-90669 | 5/1983 | Japan | 355/271 |
| 59-46664 | 3/1984 | Japan | 355/271 |
| 61-219072 | 9/1986 | Japan | 355/271 |
| 63-4562 | 1/1988 | Japan . | |

*Primary Examiner*—A. T. Grimley

*Attorney, Agent, or Firm*—Kenyon & Kenyon

[57] ABSTRACT

An electrophotographic image transfer member of bias-roller transfer type is capable of pressing a recording medium into contact with a toner image. The image transfer member has a rotatable supporting member, an elastic member provided around the supporting member, and a conductive resin layer formed on the surface of the elastic member. An electrical path is formed to enable supply of a bias voltage to the conductive resin layer. An image transfer device has the image transfer member and a cleaner capable of removing toner from the image transfer member upon frictional contact therewith. An electrophotographic apparatus has an image transfer member for bringing the recording medium into pressure contact with the toner image and for applying the bias voltage, and a mechanism for bringing the image transfer member towards and away from the photosensitive member in response to a signal indicative of execution of one of several basic steps of the electrophotographic process.

38 Claims, 7 Drawing Sheets

ELECTROPHOTOGRAPHIC IMAGE TRANSFER MEMBER, ELECTROPHOTOGRAPHIC IMAGE TRANSFER DEVICE AND ELECTROPHOTOGRAPHIC RECORDING APPARATUS

BACKGROUND OF THE INVENTION

The present invention relates to a bias-roller type image transfer technique in electrophotography. More particularly, the present invention is concerned with an image transfer member and an image transfer device of this type, a well as to an electrophotographic recording apparatus relying upon this type of technique.

In an electrophotographic recording apparatus such as a laser beam printer or a copying machine, a toner image is formed on a photosensitive member and is then transferred to a recording medium. A method called bias-roller transfer method is known as a method for transferring the toner image from the photosensitive member to the recording medium. This method is disclosed in Japanese Patent Examined Publication No. 52-33494 which corresponds to the U.S. Pat. No. 3,781,105.

The bias-roller, type transfer method employs a roller or like member, which presses a recording medium such as a sheet of paper, onto a photosensitive member while applying a bias voltage to generate an electric field by which a toner image is transferred to the recording medium. The pressing of the recording medium onto the photosensitive member may be conducted by a type of member other than a roller. For instance, the U.S. Pat. No. 3,691,993 proposes the use of a metal-coated brush as means for pressing the recording medium onto the photosensitive member. The bias-roller transfer method is superior in that it enables an image to be transferred at a high speed and with a high image quality.

The transfer roller used in this method has to be electrically conductive in order that it can apply the bias voltage, and is preferably elastic in order that it can adequately press the recording medium onto the photosensitive member.

To meet these demands, transfer rollers usually have a metallic core portion, an electrically conductive elastic layer formed on the metallic core portion and a resin layer formed on the conductive elastic layer and having a high electrical insulating power. A high voltage is applied to the conductive elastic layer through the metallic core. The conductive elastic layer is formed from a material containing a conductive additive such as carbon black and a plasticizer dispersed in a matrix of a rubber or the like material. This type of roller is shown in, for example, U.S. Pat Nos. 3,959,573 and 3,959,574.

Japanese Utility Model Unexamined Publication No. 53-129338 proposes a transfer roller which does not have such an integral conductive elastic member as that mentioned above. Namely, this transfer roller has an insulating elastic layer surrounded by a separate conductive layer which in turn is covered with an outermost resin layer having high electrical insulating power.

Proposed also is a transfer roller which is composed of a conductive elastic layer alone, without outermost layer of high insulating power. This type of roller is disclosed, for example, in Japanese Patent Unexamined Publication No. 53-77533 and also in the U.S. Pat. No. 2,807,233.

On the other hand, toner particles and carrier tend to attach to the surface of the transfer roller while the transfer roller is pressed onto the photosensitive member through the intermediary of the recording medium. A transfer device has been known which has a cleaning means, such as a brush, combined with a transfer roller. This type of transfer device is disclosed, for example, in the U.S. Pat. No. 3,847,119 and also in Japanese Patent Examined publication No. 52-33494 mentioned before.

When a transfer of a image is conducted by means of a roller of the type described above, a nip region for the recording medium is formed between the transfer roller and the surface of the photosensitive member. The area of the nip region varies according to the hardness of the transfer roller. In other words, a moderate range exists in the hardness of the transfer roller, i.e., in the stiffness of the elastic layer of the transfer roller. If a local portion of the transfer roller is held in contact with the photosensitive member, the transfer roller is deformed or convexed at such a portion, with the result that the quality of the transferred image is impaired and the life of the transfer roller is shortened.

In order to obviate this problem, image transfer devices have been proposed in which a transfer roller is mounted such that it can be brought into and out of contact with the photosensitive member, as disclosed in Japanese Utility Model Unexamined Publication No. 58-159556 which corresponds to the U.S. Pat. No. 3,907,421, as well as in Japanese Utility Model Unexamined Publication No. 63-4562. In the devices shown in this literature, the movement of the transfer roller is controlled in accordance with a signal from an operation detector which is incorporated in, for example, a paper feeding mechanism.

SUMMARY OF THE INVENTION

The outermost resin layers of high insulating power employed in the known transfer rollers are generally small in thickness. Therefore, breakdown of insulation tends to occur due to wear of the surface of the resin layer during long use or due to jamming of metallic particles in a developing agent between the transfer roller and the photosensitive member during transfer.

The aforementioned cleaning device is effective in removing toner and metallic particles attaching to the surface of the transfer roller. Transfer rollers having an outermost resin layer of high insulating power, however, tend to make the cleaning effect unstable due to accumulation of electrostatic charges caused by friction between the cleaning means and the transfer roller.

Transfer rollers of the type having no outermost layer of high insulating power are free from the problem of breakdown of insulation and exhibit small accumulation of electrostatic charge caused by friction with cleaning means. This type of transfer roller, however, encounters a problem in the removal of toner particles from the single layer of conductive rubber, which is difficult and, hence, tends to cause the reverse side of the recording medium to be contaminated.

The arrangement for selectively bringing the transfer roller into and out of contact with the photosensitive member is disadvantageous in that the cost of the electrophotographic recording is raised due to an increase in the number of parts including the operation detector.

Accordingly, the present invention provides an image transfer member which is free from the problem of breakdown of insulation and which is easy to clean.

The present invention also provides an image transfer device which enables an easy cleaning of the image transfer member so that the risk of contamination of the recording medium is remarkably reduced.

The present invention also provide an electrophotographic recording apparatus which enables, with a simple mechanism, an image transfer member to be brought into and out of contact with the photosensitive member.

To these ends, according to one aspect of the present invention, an electrophotographic image transfer member comprises a carrier member, an elastic member surrounding the carrier member and an electrically conductive resin layer formed on the elastic member. The conductive resin layer is contactable with the recording medium. Provided also is an electrical path leading to the conductive resin layer.

In the above-mentioned image transfer member, the outermost conductive resin layer reduces a voltage difference across this layer so as to prevent breakdown of insulation. In addition; the resin layer coats the elastic member which exhibits high adhesion to the toner particles, thus offering good cleaning characteristics of the transfer member.

According to another aspect of the present invention, there is provided an electrophotographic image transfer device which has an electrophotographic image transfer member of the kind described above and a cleaner which is capable of removing toner particles from the transfer member upon frictional contact therewith.

As described above, the image transfer member described above has excellent cleaning characteristics so that it enables an easy removal of toner particles therefrom by means of the cleaner which makes a frictional contact therewith. Electrostatic charges generated as a result of frictional contact between the cleaner and the image transfer member are diffused through the conductive surface layer so that cleaning of toner particles is satisfactorily effected while breakdown of the image transfer member is avoided. Preferably, an electrical path is provided to allow electrostatic charges generated on the surface of the image transfer member to be discharged.

According to still another aspect of the present invention, there is provided an electrophotographic recording apparatus in which a recording medium is pressed onto an image developed by a toner on a photosensitive member while a bias voltage is applied thereby allowing the developed toner image to be transferred from the photosensitive member to the recording medium. The apparatus has an image transfer member which is capable of pressing the recording medium onto the photosensitive member while applying a bias voltage, and a mechanism for moving the image transfer member towards and away from the photosensitive member. This mechanism is capable of operating so as to move the image transfer member in accordance that an operation signal which is generated in response to execution of one of the steps of the electrophotographic process, starting with operation of a recording medium supply hopper and charging and terminating in fixing of image.

In the electrophotographic apparatus described above, the movement of the image transfer member with respect to the photosensitive member is controlled by using, with or without a delay, a signal indicative of the start or end of the basic operation of the apparatus. As a consequence, the transfer member becomes operative whenever the operation is necessary, so that a specific detector is not needed for the purpose of controlling the movement of the transfer member. It is thus possible to prevent undesirable local deformation of the image transfer member and, hence, to avoid any undesirable effect which may otherwise be caused by a local deformation, without requiring complicated construction of the apparatus.

BRIEF DESCRIPTION OF THE DRAWINGS

The above and other objects, features and advantages of the present invention will become clear from the following description of the preferred taken in conjunction with the accompanying drawings, as well as from the statement of appended claims.

DETAILED DESCRIPTION

Preferred embodiments of the present invention will be described with reference to he accompanying drawings.

Figure 1:
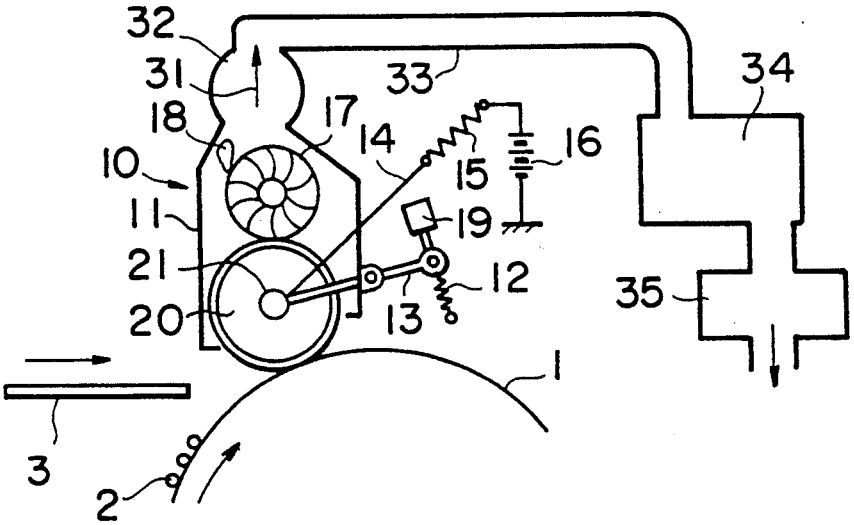
FIG. 1 is a schematic illustration of an embodiment of the image transfer device in accordance with the present invention.

FIG. 1 shows a first embodiment of a bias roller-type image transfer device 10 of the present invention. The image transfer device 10 is disposed above and adjacent to a photosensitive member 1. The photosensitive member 1 is rotatable in the direction of the arrow in the figure so as to bring a toner-developed latent image to a transfer position A recording medium such as a sheet of paper is fed into the space between the device 10 and the photosensitive member 1. The steps of electrophotographic process such as formation of an electrostatic latent image and development thereof are all known and are not described.

The image transfer device 10 has an image transfer roller 20 which serves as an image transfer member. The image transfer roller 20 is rotatably carried through bearings by a transfer device frame 11 which is capable of moving the transfer roller 20 towards and away from the photosensitive member 1. In order to enable the recording medium to make close contact with the photosensitive member 1, a spring 12 is provided so as to exert a suitable level of urging force which is transmitted to the roller 20 through a torque member 13 supporting the transfer roller 20.

The transfer roller 20 has a core metallic member 21 which serves as a rotary shaft An electrical power supply 16 is connected to the core metal member 21 through a lead line 14 and a resistor 15 and further through a carbon brush contacting therewith, so that a bias voltage can be applied to the core metallic member 21.

Figure 2:
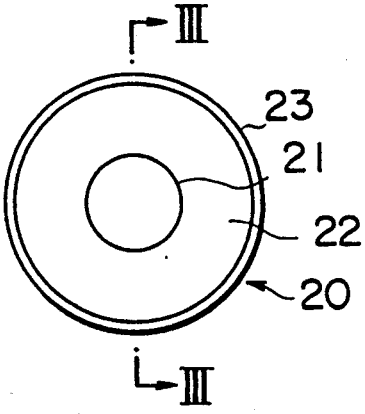
FIG. 2 is a sectional view of an image transfer roller of the present invention.
Figure 3:
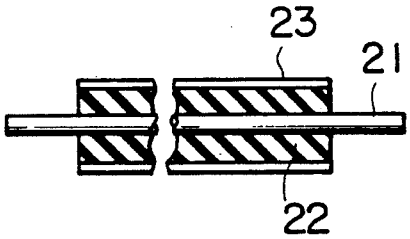
FIG. 3 is a sectional view taken along the line III—III of FIG. 2.

A detailed description will be given of the image transfer roller 20 with specific reference to FIGS. 2 and 3. The image transfer roller 20 has a conductive elastic layer, such as of a conductive rubber or a conductive sponge, surrounding the core metallic member 21, and an outermost conductive resin layer 23 covering the conductive elastic layer 22. The core metallic member 21 is made of a conductive metallic material or a material equivalent thereto, e.g., stainless steel, aluminum, iron, glass fibers and so forth. The metallic core member 21 contacts at its one or both ends with an electric power supply member such as the above-mentioned carbon brush or bearings so as to be supplied with a voltage. The conductive elastic layer 22 is made of a rubber material which can exhibits even with dispersion of a conductive additive to develop a suitable level of electrical conductivity, a required level of softness or elasticity which is about 40 degrees or less, preferably between 18 and 35 degrees, in terms of rubber hardness as specified by JIS A. Thus, a conductive silicon rubber, conductive urethane rubber or a conductive sponge formed by allowing a conductive urethane to foam, are suitably used as the material of the conductive elastic layer. The softness or elasticity as specified above is necessary because high hardness of the transfer roller 20 tends to cause damage on the photosensitive member. The conductive resin layer 23 is preferably made from a material which allows an easy separation of toner particles therefrom, in order to ensure good cleaning characteristics of the transfer roller 20. It is also preferred that the material of the conductive resin layer 23 exhibits superior mechanical strength, even when the material is formed into a thin film having an extremely small thickness of 10 to 100 μm. The present inventors have found that electrically conductive fluororesin, electrically conductive silicon resins, electrically conductive nylon and electrically conductive polyimide resins can suitably be used as the material of the conductive resin layer 23.

The inventors also have found that, considering the transferability of the toner and dielectric strength of the photosensitive material, the resistance value Rf between the surface of the image transfer roller and the core metallic member per unit area of the transfer roller preferably ranges between $1\times10^{8}\Omega$ and $5\times10^{9}\Omega$. If the resistance value is below this range, the recording medium may be over-charged due to excessively large electric current which flows during the transfer, resulting in various troubles such as clinging of the recording medium to the photosensitive member such as a drum, disturbance of the transferred toner image due to an arc discharge, and so forth. Conversely, when the resistance value is above the range specified above, it is necessary to apply a very high voltage, e.g., about 2000 V or higher, to the transfer roller 20 to obtain the required transfer efficiency. Application of such a high voltage, however, may cause a breakdown of the photosensitive layer due to contact with the image transfer roller 20, particularly when the thickness of the photosensitive layer is very small, e.g., about 30 μm or less, as is the case of the layer made from an organic photosensitive material or amorphous silicon. The preferred range of the resistance value mentioned above is based on an assumption that the image transfer roller has a diameter of about 30 mm. The image transfer roller of the present invention is usually used at a bias voltage of 500 to 1500 V applied thereto.

In order to prevent breakdown of insulation of the conductive resin layer 23 upon trapping of the carrier, it is necessary that the condition of the following formula (1) is met, so that the electric field intensity $E_s$ of the conductive resin layer 23 does not take a value which is extremely large as compared with the electric field intensity $E_G$ of the conductive elastic layer 22.

$$E_S \leqq 10\times E_G \quad (1)$$

Representing the thickness of each layer by l, resistance per unit area by R and the specific resistance by p, formula (1) can be transformed into the following formula (2).

$$(R_s/l_s) \leqq 10\times(R_G/R_G) \quad (2)$$

Using the relationships of $R_s = ps.l_S$, $R_G = pG.lG$, the formula (2) is transformed into the following formula (3).

$$ps \leqq 10\times P_G$$

This means that the specific resistance of the conductive resin layer 23 should be determined to be not greater than a value which is 10 times as large as the specific resistance of the conductive elastic layer 22.

Figure 4:
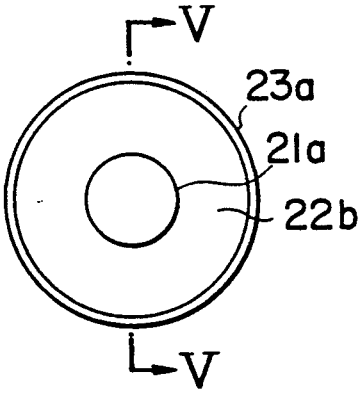
FIG. 4 is a sectional view of a modification of the image transfer roller shown in FIG. 2.
Figure 5:
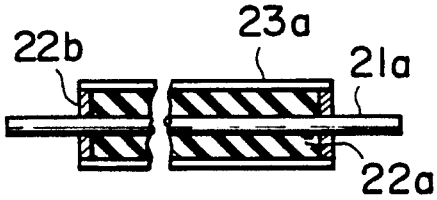
FIG. 5 is a sectional view taken along the line V—V of FIG. 4.

FIGS. 4 and 5 show a modification of the image transfer roller of the present invention. This modification is different from the described image transfer roller 20 in that an insulating elastic layer **22*a* (FIG. 5) is formed around the core metallic member 21*a* and that conductive members 22*b* are provided on both axial ends of the roller so as to provide electrical connection between the conductive resin layer 23*a* and the core metallic member 21. Although the members 22*b* have disk-like form in the illustrated embodiment, this is not exclusive and the conductive member 22*b* can have any other form. This modification offers an advantage in that the low-hardness rubber usable as the material of the insulating elastic layer 22*a* can have a wider selection because the rubber need not contain any conductive additive, although, the number of parts is increased due to use of the conductive members 22*b*. Thus, the modification shown in FIGS. 4 and 5 allows the use of rubber materials which are softer than that used in the image transfer roller 20 shown in FIGS. 2 and 3**.

The conductive resin layer 23 or **23*a* may be formed by various methods. For instance, a solution prepared by dissolving a conductive resin in a solvent or the like is applied to the surface of a conductive or insulating elastic layer. Alternatively, a conductive resin tube is made to fit on a previously formed elastic layer. It is also possible to allow a conductive rubber in liquid state to flow into a conductive resin tube and then be solidified in the tube. It is possible to provide a primer layer in order to attain good affinity between the conductive resin layer 23, 23***a* and the elastic layer 22, 22*a*. The term "conductive" is used in this specification to mean resistivity levels which are not greater than $10^8$ to $10^9$ Ωcm.

Figure 6:
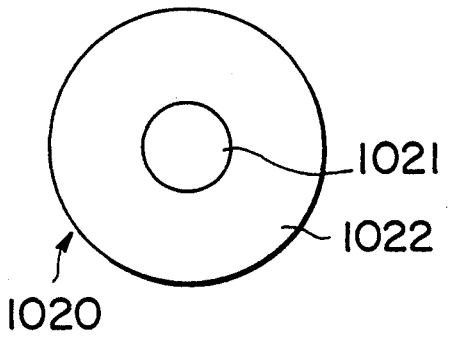
FIG. 6 PRIOR ART
FIGS. 6 and 7 are sectional views of conventional transfer rollers.
Figure 7:
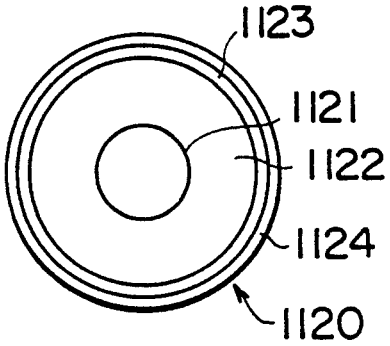
FIG. 7 PRIOR ART

FIGS. 6 and 7 show conventional image transfer rolls, for the purpose of comparison with the image transfer roll of the present invention. The image transfer roll 1020 shown in FIG. 6 has a core metallic member 1021 and an elastic layer 1022 of conductive rubber. On the other hand, the transfer roll 1120 shown in FIG. 7 is composed of a core metallic member 1121, an insulating elastic layer 1122 surrounding the core metallic member 1121, a conductive elastic layer 1123 surrounding the insulating elastic member 1122, and an outermost resin layer 1124 having high insulating power.

Referring back to FIG. 1, the image transfer device 10 is provided with a cleaning means for removing toner particles from the image transfer roller 20. The cleaning means includes a rotary brush 17 capable of rotating in frictional contact with the image transfer roller 20, and a beating rod !8 contacting the rotary brush 17. The toner particles removed from the image transfer roller 20 are adapted to be sucked and discharged together with air by a suction blower. In order to suck the toner particles from the interior of the transfer device frame 11, a suction blower 35 is connected to the interior of the transfer device frame 11 by way of a manifold 32, a suction pipe 33 and a toner filter 34.

In order to allow electrostatic charge accumulated on the rotary brush 17 to be dissipated, it is preferred that the beating rod 18 is grounded and that the resistance between the surface of the brush 17 and the base is determined to range between $10^8$ and $10^{11}\Omega$. This is because a too low resistance of the cleaning brush tends to allow a leak of the bias voltage so as to impair the image transfer characteristics.

The cleaning means having the described construction is comparatively large in size but can advantageously reduce the influence of the generated electrostatic charge due to discharge of the toner by suction air.

The image transfer device 10 has a roller moving mechanism which is capable of moving the image transfer roller 20 into and out of contact with the photosensitive member 1. The roller moving mechanism includes the link member 13 mentioned above, a pressing spring 12, a solenoid 19 and so forth. The solenoid is selectively energized in accordance with a predetermined sequence signal so as to bring the image transfer roller 20 into and out of contact with the photosensitive member 1.

The provision of the resistor 15 is not essential. Namely, the resistor 15 maybe dispensed with when the resistance value $R_r$ of the image transfer roller 20 falls within the range described before. However, when the resistance value of the transfer roller 20 is about $10^6\Omega$ or lower and is difficult to adjust, the resistor 15 is used and adjusted to a resistance value which ranges between $5\times10^6$ and $10^8\Omega$.

Figure 8:
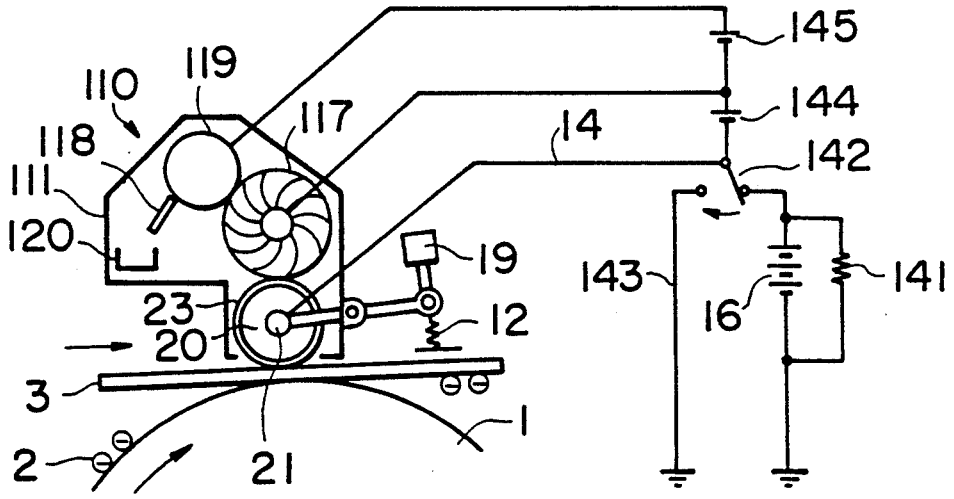
FIG. 8 is a schematic illustration of another embodiment of an image transfer device of the present invention.

A description will be given of a second embodiment of the image transfer device of the present invention with reference to FIG. 8. In the following description, the same reference numerals are used to denote the same parts or members as those used in the first embodiment, and a detailed description of such parts or members is omitted.

The image transfer device 110 of the second embodiment also is composed of an image transfer roller 20, a cleaning means and a roller moving mechanism. A discharge resistor 141 is connected in parallel to the bias power supply 16. The discharge resistor 141 forms an electrical path for allowing electrostatic charges to be discharged to the ground. The discharge resistor 141 may be built into the bias power supply 16 or connected externally in parallel with the power supply 16. The discharge resistor has a resistance value of $10^9\Omega$ to $10^{11}\Omega$. The arrangement may be such that the lead line 14 is connected through a changeover switch 142 to a non-transfer electrical path 143 when the transfer of the image is not being conducted.

The cleaning means includes a conductive rotary brush 117 making frictional contact with the transfer roll 20, a collector roll 119 contacting with the brush, a blade 118 contacting with the roll 119 and a toner collector 120. These parts of the cleaning means are accommodated in an image transfer device frame 111. Power supplies 144 and 145 are connected to the conductive brush 117 and the collector roll 119, respectively. These power supplies are capable of applying a cleaning bias voltage and a collection bias voltage to the conductive brush 117 and the collector roll 119, respectively. These voltages are of a polarity opposite to that of the toner. As a consequence, toner particles attaching to the surface of the image transfer roll 20 are scraped off the roll 20 by the rotary brush 117 and then delivered to the collector roll 119. The toner particles are then scraped off the collector roll 119 by the blade 118.

To ensure a close contact between the collector roll 119 and the conductive brush 117 and to promote the delivery of the toner and carrier from the brush 117 to the roll 119, the surface of the collector roll 119 may be roughened to have fine convexities or concavities of 10 to 100 μm high or deep.

As in the case of the first embodiment, the conductive resin layer 23 formed on the surface of the image transfer roller 20 in the second embodiment facilitates the removal of the toner particles from the surface of the image transfer roller. Furthermore, since the surface layer of the image transfer roller 22 is electrically conductive and partly because the discharge resistor 141 is provided in the bias power supply 141, electrostatic charges generated as a result of frictional contact between the image transfer roller 20 and the conductive brush 117 are allowed to be discharged to the ground from the surface layer 23 of the image transfer roller 20 through the conductive elastic layer, core metallic member 21, lead wire 14 and the discharge resistor 141. It is therefore possible to avoid accumulation of electrostatic charges on the surface of the image transfer roller 20, thus ensuring a stable cleaning characteristic of the image transfer roller 20.

Figure 9:
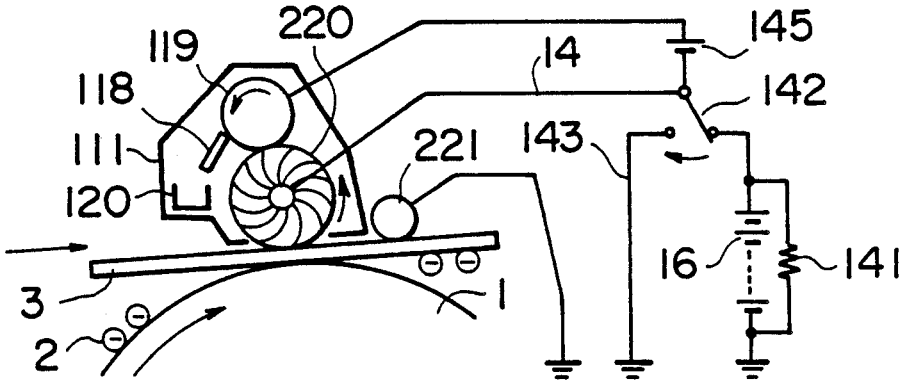
FIG. 9 is a schematic illustration of still another embodiment of an image transfer device of the present invention.

FIG. 9 shows a third embodiment of the image transfer device of the present invention. This embodiment has an image transfer member in the form of a conductive brush 220. The conductive brush 220 is composed of a multiplicity of bristles made of a conductive resin and a core metallic member which supports these bristles. A bias power supply 16 is connected to the conductive brush 220. Therefore, the conductive brush 220 plays two role: namely, it acts as an image transfer member and as a cleaner for bringing the toner particles 2 to a position where the brush contacts with a collector roll 119.

In the third embodiment of the image transfer device of the present invention, the recording medium 3 is charged at its reverse side by the conductive brush 220, so that image transfer performance of this embodiment is rather inferior particularly in regard to the transfer of fine or delicate image, as compared with those of the preceding embodiments in which the recording medium 3 is pressed by an image transfer roller into closer contact with the photosensitive member 1. On the other hand, however, this embodiment enables a remarkable reduction in the size of the whole device. In addition, there is no risk for the image transfer member to be damaged by magnetic carrier particles such as iron powder, ferrite powder and so forth contained in the developing agent. In FIG. 9, reference numeral 221 denotes a grounded roller for allowing discharge of electrostatic charges which are generated on the recording medium 3 as a result of frictional contact between the recording medium 3 and the conductive brush.

Figure 10:
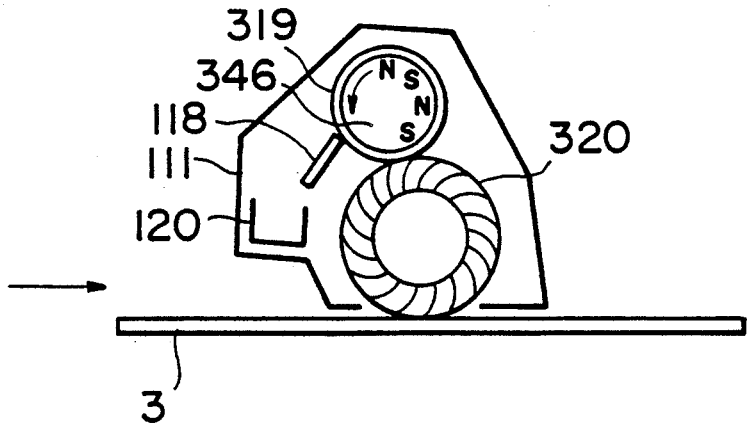
FIG. 10 is a schematic illustration of a modification of the transfer device.

FIG. 10 illustrates a modification of the image transfer device shown in FIG. 9. Thus, the image transfer member is constituted by a conductive brush 320 in this modification. A collector roll 319 which contacts with the conductive brush 320 is provided therein with a plurality of magnets 346 so that it can collect both the toner on the conductive brush 320 and the carrier. The conductive brush 320 may be constructed such that each of bristles of the brush 320 is magnetic. In such a case, the conductive brush 320 exhibits a greater carrier removing effect.

Figure 11:
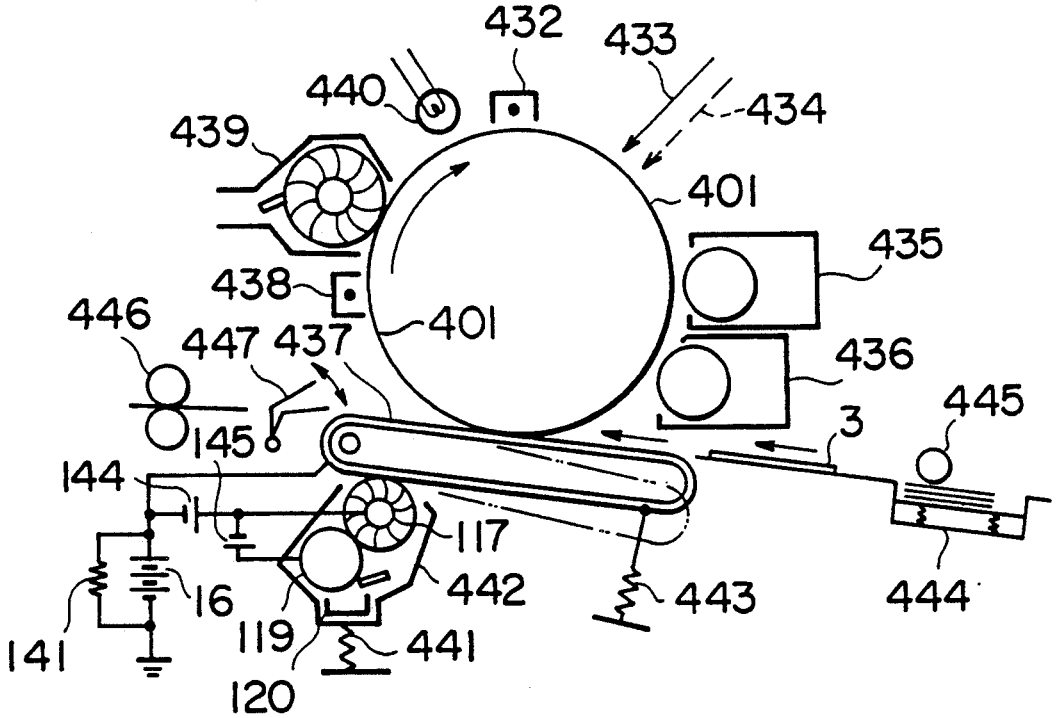
FIGS. 11 and 12 are schematic illustrations of electrophotographic recording apparatus incorporating an image transfer device of the present invention.

FIG. 11 illustrates an electrophotographic apparatus incorporating an image transfer device of the present invention. The apparatus is designed to perform bicolor printing during two revolutions of the photosensitive member 401. The image transfer device incorporates an image transfer member in the form of an image transfer belt 437 having a conductive resin layer formed thereon, a cleaning unit 442 associated with the transfer belt 437, a transfer belt moving mechanism 443 and a cleaning unit moving mechanism 441.

The electrophotographic apparatus has the following parts arranged around the photosensitive member 401: a charger 432, an exposure device capable of performing monotone printing exposure 433 and color printing exposure 434, black toner developing device 435 and a color toner developing device 436. Disposed also are a cleaning charge remover 438, for removing charges from the residual toner for the purpose of cleaning, a cleaner 439 for removing the toner particles and a charge-removing light source 440, around the portion of the photosensitive member 401 downstream of the portion near the transfer belt 437.

A plurality of sheets of recording paper as the recording medium 3 are stacked in a sheet stack hopper 444 and are fed to a transfer position in a one-by-one fashion by means of a paper feeding roller 445. A movable paper path switching claw 447, for holding the recording medium 3 until bi-color printing is finished, and a fixing roller 446 are disposed adjacent to the downstream end of the transfer belt 437 as viewed in the direction of feed of the recording medium 3.

In operation, a black toner image is formed on the photosensitive member 401 during the first rotation of the photosensitive member 401. The thus formed black toner image is transferred to the recording medium 3. The recording medium path switching claw 447 holds the recording medium so that the recording medium 3 carrying the black toner image is carried by the moving image transfer belt 437 without being conveyed from the image transfer position. Then, a color toner image is formed on the photosensitive member 401 during a second rotation of the same and is transferred to the recording medium 3 carried by the transfer belt 437. Subsequently, the recording medium 3 is moved to a fixing station where the bi-color toner image is fixed to the recording medium by means of a fixing roller 446, whereby bi-color printing is finished.

The transfer belt moving mechanism 443 is provided to allow the image transfer belt 437 to be kept away from the photosensitive member 401 when a jamming paper is removed or when it is desired to demount and mount the photosensitive member 401. The cleaning unit moving mechanism 441 is provided to prevent the conductive brush 117 from scraping the black toner image off the surface of the recording medium 3 during one full rotation of the recording medium 3 carried by the image transfer belt 437. The present invention applied to the described bi-color electrophotographic recording apparatus offers excellent and stable cleaning characteristics of the image transfer member.

Figure 12:
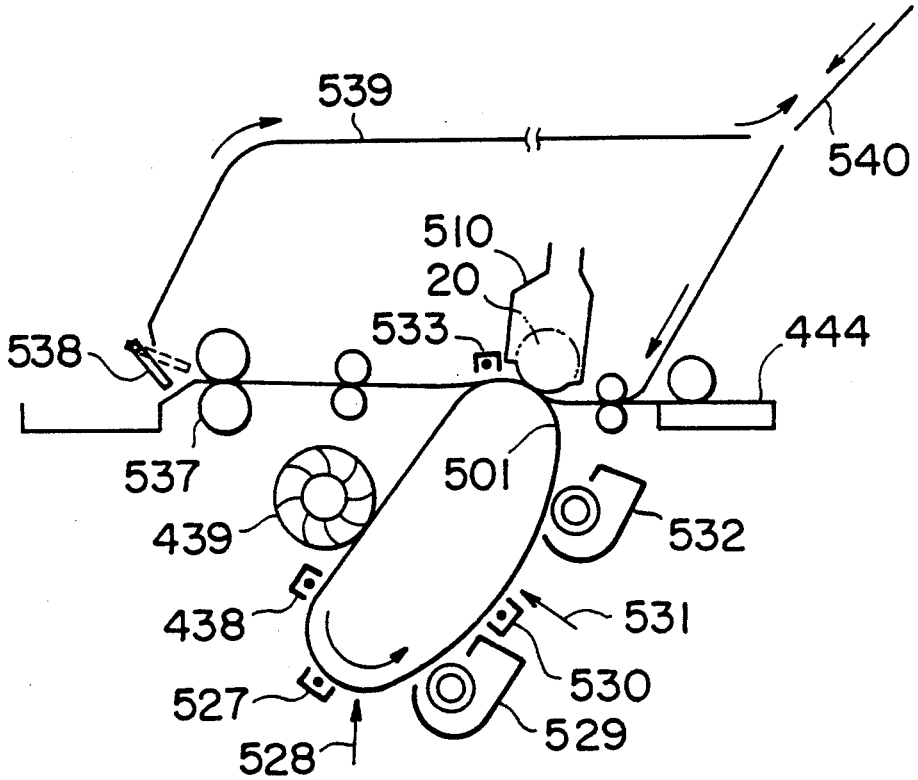

FIG. 12 illustrates an application of the image transfer device of the present invention to an electrophotographic apparatus of the type which conducts transfer of a bi color image in one full rotation of the photosensitive member. This electrophotographic apparatus has a sheet inversion mechanism and, hence, is capable of performing double-sided printing, i.e., printing on both sides of a single sheet of recording medium.

More specifically, this electrophotographic apparatus has a belt-like photosensitive member 501 around which are disposed chargers 527, 530, exposure devices 528, 531 and developing units 529, 532 which are intended for forming a bi-color toner image. The sheet inverting mechanism is composed of a sheet path switching valve 538, an inversion path 539 and a switch-back device 540 which are disposed on the rear side of the fixing device 537. A separation corotron 533 for removing charges from the recording sheet so as to enable separation from the photosensitive member is provided behind the image transfer device 510. It will be seen that the image transfer device of the prevent invention can be applied also to a double-sided bi-color printing apparatus having the described construction, offering advantages in that (1) any transfer attributable to wrinkling of the recording sheet caused during convey along the inversion path is avoided and in that (2) excellent transfer characteristics are obtained for two kinds of toners having different characteristics.

The image transfer device of the prevent invention can also be used in various other recording devices such as printers connected to a computer system, printers of facsimiles, printers of word processors and so forth, and excellent and stable cleaning characteristics of the image transfer member are also obtained in such uses.

Figure 13:
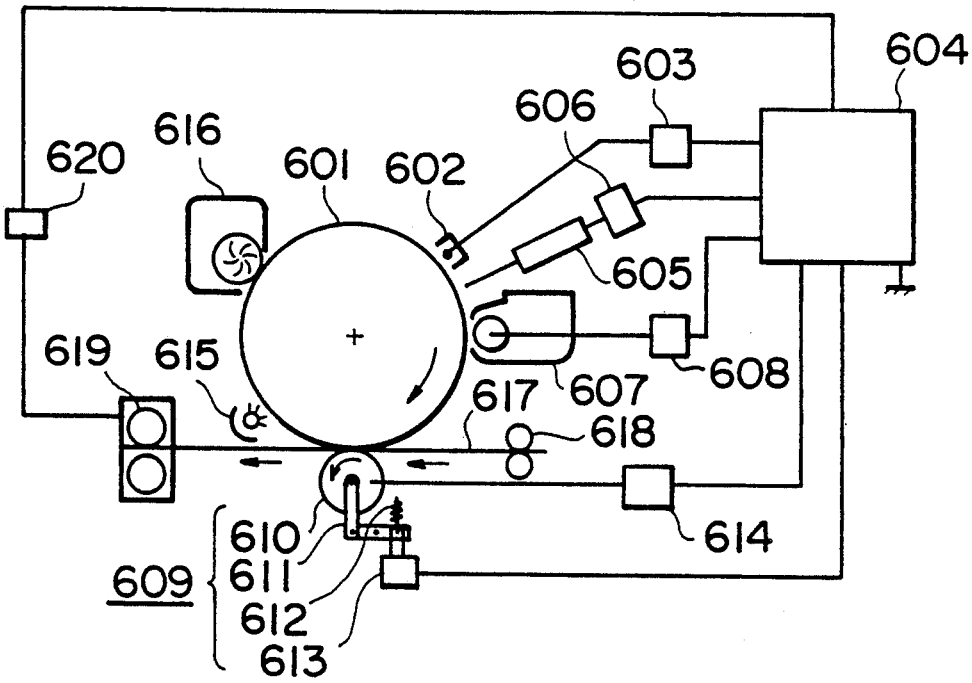
FIG. 13 is a schematic illustration of another embodiment of the electrophotographic recording apparatus.

Still another electrophotographic recording apparatus of the present invention will be described with reference to FIG. 13. Referring to FIG. 13 illustrating the whole of the electrophotographic apparatus, a charger 602, an image exposure device 605, a developing device 607, an image transfer roller unit 609 and a charge removing light source 615 are arranged in that order around a photosensitive drum 601 which is an image carrier. In this embodiment, the image transfer roller unit 609 is disposed beneath the photosensitive drum 601. The charger 602, which may be a corotron or a scorotron, is connected to a high-voltage power supply 603. The high-voltage power supply 603 operates under the control of a sequencer 604 so as to supply the charger 602 with a high-voltage signal (charging signal) as the basic operation signal in the form of pulses, so as to charge the photosensitive drum 601.

A control circuit 606, connected to the image exposure device 605, is capable of operating under the control of the sequencer 604 so as to supply the image exposure device 605 with the exposure signal as the basic operation signal in the form of pulses. The image exposure device 605 illuminates the photosensitive drum 601 when it is in receipt of the exposure signal. When the electrophotoqraphic apparatus is a copying machine, the illuminating light is a light corresponding to the original image, so that charges are left only on the portions of the surface of the photosensitive drum 601 where no light was applied, i.e., only at the portions corresponding to black portions of the original image, whereby an electrostatic latent image is formed.

A bias power supply 608 is connected to the developing device 607 which accommodates a toner. The bias power supply 608 is operative under the control of the sequencer 604 so as to supply a bias voltage as a basic operation signal in the form of pulses, so that toner particles attach to the charged portions of the surface of the photosensitive drum 601.

The image transfer roller unit 609 has an image transfer roller 610 to which is connected a bias power supply 614. The arrangement is such that, when the image transfer roller 610 is pressed onto the photosensitive drum 601 through the intermediary of the recording paper sheet 617 which has been fed through a register roller 618, the toner image formed on the surface of the photosensitive drum 601 is transferred to the recording paper sheet 617 as a bias voltage is applied between the image transfer roller 610 and the photosensitive drum 601. The recording paper sheet 617 is then made to pass through a fixing station where the toner image which has been transferred to the recording paper sheet 617 is fixed thereto by means of the fixing roller 619.

As the photosensitive drum 601 is further rotated, the portion of the surface of the photosensitive drum 601 from which the toner image has been transferred to the recording paper sheet 617 is brought to a position where it is illuminated by the charge removing light source 615 so that any residual charges are removed to free residual toner particles. The residual toner particles are then scraped off the photosensitive drum 601 by the cleaning device 616.

The transfer roller unit 609 includes an image transfer roller 610, L-shaped arms 611, a return spring 612 and a solenoid 613. The arms 611 are pivotally supported at their bent central portions by a pivot shaft and the image transfer roller 610 is rotatably carried by one end of the arms 611 while the other end of the arms 611 is connected to a plunger of a solenoid 613. In operation, the solenoid 613 is energized by a control signal from a sequencer 604 so that the plunger is moved downward with the result that the arms 61 are swung about the pivot shaft so as to cause the image transfer roller 610 to move upward into pressure contact with the photosensitive drum 601. Then, as the solenoid 613 is de-energized, the plunger is moved downward by the force of the return spring 612, so that the image transfer roller 610 to be moved away from the photosensitive drum 601.

Figure 14:
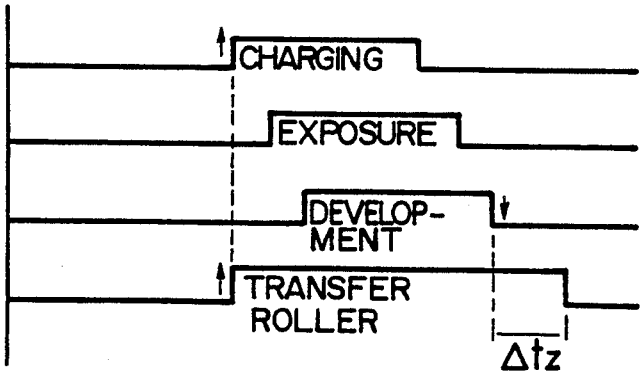
FIG. 14 is a timing chart illustrative of the operation of the apparatus shown in FIG. 13.

FIG. 14 is a time chart illustrating the timing of the signal for energizing the solenoid 613 for actuating the image transfer roller 610 in relation to the other basic signals such as the charging signal, exposure signal and developing signal which are issued during one copying cycle for producing a copy of an original on a recording paper sheet 601. When the electrophotographic apparatus is not operating, the image transfer roller 610 is kept away from the photosensitive drum 601. It is therefore necessary to bring the transfer roller 610 into pressure contact with the photosensitive drum before the transfer operation is commenced. More specifically, the image transfer roller 610 has to be brought into pressure contact with the photosensitive drum 601 when or before the leading end of the recording paper sheet has reached the nip formed between the photosensitive drum 601 and the image transfer roller 610. In this embodiment, the electric current for energizing the solenoid 613 of the transfer roller unit 609 is supplied in synchronism with the ON-timing at which the charging signal of about 1000 V is started to be applied to the charger 602 by the high-voltage source 603 in the charging step which is one of the steps preceding to the image transfer step. The solenoid 613 is energized simultaneously with the turning on of the charging signal so as to attract the plunger thereby bringing the image transfer roller 610 into pressure contact with the photosensitive drum 601. The time interval $\Delta t_1$ between when a portion of the surface of the photosensitive drum 601 is moved from a position where it faces the charger to a position where it faces the image transfer roller is obtained by dividing the distance $\Delta l_1$ between both positions measured along the periphery of the photosensitive drum 601 by the peripheral speed of the photosensitive drum 601. Assuming here that a photosensitive drum having a diameter of 200 mm is rotated at a peripheral speed of 130 mm/s and that the distance between the charger and the and the transfer roller along the periphery of the photosensitive drum is about 240 mm, the time interval from the moment at which the ON signal for starting the charger 602 is received and the moment at which the leading end of the charged portion of the surface of the photosensitive drum reaches the position where it faces the image transfer roller 610 is about 1.9 seconds. Therefore, if the arrangement is such that the image transfer roller 610 is brought into pressure contact with the photosensitive drum 601 at the same time as the the charging signal is turned on, the image transfer roller 610 is uselessly held in contact with the photosensitive drum 601 for the period of about 1.9 seconds. In order to obviate this useless contact period, it is possible to use a delay circuit so that the image transfer roller 610 is moved into contact with the photosensitive drum 601 with a certain time delay after the turning on of the charging signal.

In order to minimize local deformation of the image transfer roller 601, it is necessary that the transfer roller 610 is moved away from the photosensitive drum 601 without delay after completion of the image transfer. Preferably, the separation of the image transfer roller 610 is conducted when the trailing end of charged portion of the recording paper sheet has left the nip between the image transfer roller 610 and the photosensitive drum 601. The time interval between the moment at which the development is completed and the moment at which the movement of the image transfer roller 610 away from the photosensitive drum 601 is started will be described with specific reference to a case where the above-mentioned photosensitive drum of 200 mm diameter and rotating at peripheral speed of 130 mm/s is used. Assuming that the distance between the developing device 607 and the image transfer roller 610 as measured along the periphery of the photosensitive drum 601 is 160 mm, the time required for the trailing end of the developed image to reach the position where it faces the image transfer roller 610 is approximately 1.23 seconds (160/130). Thus, the separation of the image transfer roller 610 from the photosensitive drum 601 may be commenced at a moment which is 1.23 seconds after turning off of the developing signal. Practically, therefore, the movement of the image transfer roller 610 away from the photosensitive drum is commenced by de-energizing the solenoid 613 after elapse of a predetermined time elapses, $\Delta t_2$ which is longer than 1.23 seconds, e.g., 1.5 seconds.

Figure 15:
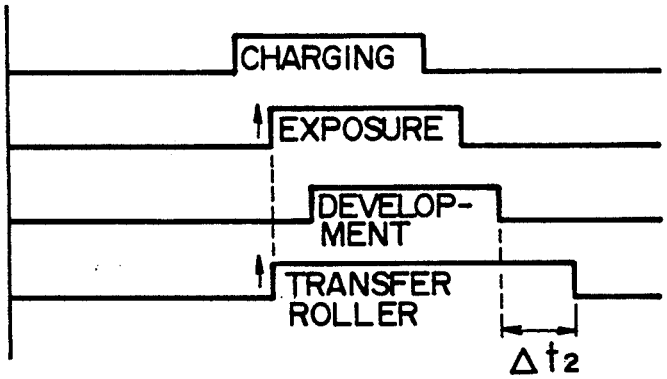
FIGS. 15 to 18 are timing charts illustrative of operation of modifications of the apparatus shown in FIG. 13.

FIG. 15 is a timing chart illustrative of a modification of the embodiment shown in FIGS. 13 and 14. In this modification, the solenoid 613 is energized to bring the image transfer roller 610 into pressure contact with the photosensitive drum 601 in synchronization with the turning on of the exposure signal. Assuming that a photosensitive drum of 300 mm diameter is rotated at a peripheral speed of 130 mm/s and that the distance between the image exposure device 605 and the image transfer roller 610, as measured along the periphery of the photosensitive drum, is 240 mm, the image transfer roller 610 is brought into pressure contact with the photosensitive drum 601 which is about 1.9 seconds before the start of the image transfer. It is possible to employ a delay circuit to delay the timing of movement of the image transfer roller 610 so as to shorten the period of useless contact as in the case of the embodiment shown in FIGS. 13 and 14. The time interval $\Delta t_2$ between the moment at which the developing signal is turned off and the moment at which the movement of the image transfer roller 610 away from the photosensitive drum 601 is commenced may be the same as that discussed in connection with the embodiment shown in FIGS. 13 and 14.

Figure 16:
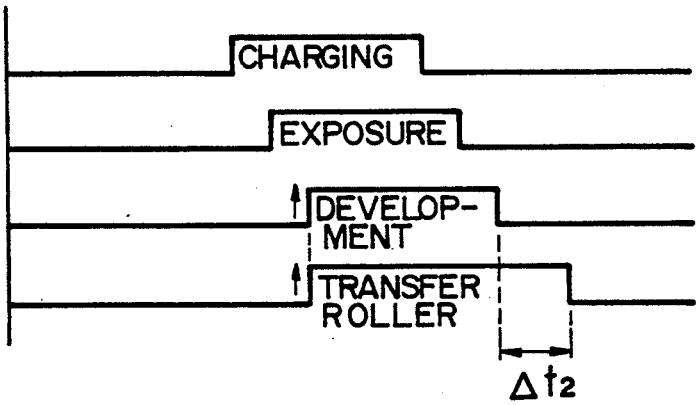

FIG. 16 is a timing chart illustrative of operation of another modification of the embodiment shown in FIGS. 13 and 14. In this embodiment, the solenoid 613 is energized to bring the image transfer roller 610 into pressure contact with the photosensitive drum 601 in synchronization with turning on of the developing signal for commencing the development, which is the step immediately before the image transfer. In this modification, therefore, the time between the moment at which the image transfer roller is brought into contact with the image transfer roller and the moment at which the image transfer is commenced can be shortened. It is possible to employ a delay circuit to delay the timing of movement of the image transfer roller 610 so as to shorten the period of useless contact, as in the case of the embodiment shown in FIGS. 13 and 14.

The image transfer roller 610 used in the embodiments and modifications described hereinbefore are of an "idle type", i.e., the image transfer roller 610 itself is not power driven but is frictionally driven by the photosensitive drum 601 which is power driven. The idle type image transfer roller 610 tends to slip on the recording paper sheet nipped between the image transfer roller 610 and the photosensitive drum 601 depending on the material and the condition of surface of the image transfer roller 610. Such a slip causes troubles such as an improper orientation of the recording paper sheet and wrinkles of the same, which can adversely affect the quality of the print.

In order to overcome this problem, a system has been proposed in which the image transfer roller 610 is power driven so as to rotate at the same peripheral speed as the photosensitive drum 601. The driving power for driving the image transfer roller 610 maybe derived from the drive shaft of the photosensitive drum 601 through a belt type power transmission means. This driving system is advantageous in that the production cost is reduced because both the photosensitive drum 601 and the image transfer roller 610 are driven by a single motor, but involves a problem concerning the reliability of operation. Namely, in general, initial setting of the belt-type driving system involves a certain margin of dimension. During long use of the driving system, therefore, a play involved in the driving system is increased so that a rotational phase difference is caused between the photosensitive drum 601 and the image transfer roller 610. In order to obviate this problem, it is necessary to take a suitable countermeasure.

Figure 17:
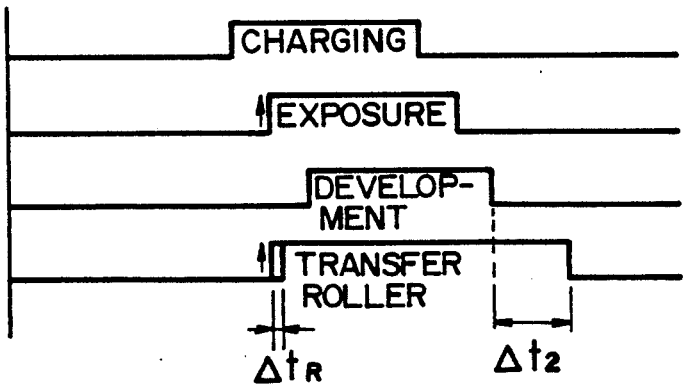
Figure 18:
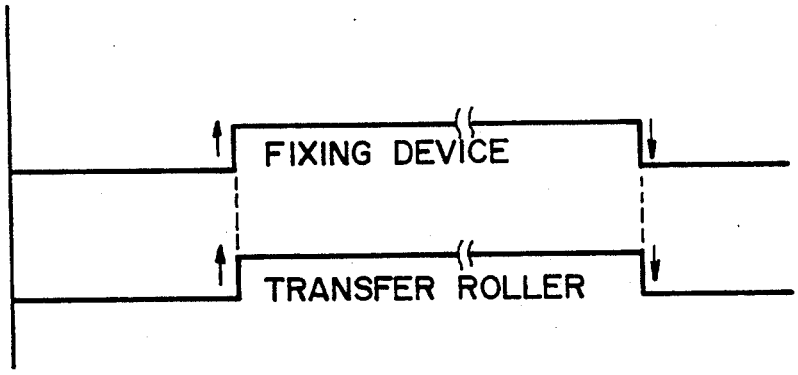

The necessity for such countermeasure will be obviated by an arrangement such that the image transfer roller and the photosensitive drum are driven by independent driving power sources. The use of independent driving power sources, however, requires that the following measures are taken. Referring to FIG. 17, it is assumed that the image transfer roller 610 is brought into pressure contact with the photosensitive drum 601, i.e., the solenoid 613 is energized, in synchronization with the turning on of the exposure signal. This arrangement, however, causes a difference between the peripheral speeds of the photosensitive drum 601 and the image transfer roller 610 because in most cases the driving power source of the image transfer roller 610 is started concurrently with the turning on of the exposure signal. To avoid this problem, it is advisable that a predetermined delay or time interval $\Delta_{TR}$ is set between the moment at which the driving power source for the image transfer roller 610 is started concurrently with the turning on of the exposure signal and the moment at which the solenoid 613 is energized to bring the image transfer roller 610 into contact with the photosensitive drum 610. According to this arrangement, the image transfer roller 610 is brought into contact with the photosensitive drum 601 after the peripheral speed of the image transfer roller 610 has been increased to the same level as that of the photosensitive drum 601. The time interval $\Delta_{TR}$ is preferably set to be 1 to 1.5 seconds. The remaining time which is 0.4 to 0.9 seconds is enough to bring the image transfer roller into pressure contact with the photosensitive drum.

Examples of timing at which the image transfer roller is brought into pressure contact with the photosensitive drum has been described with specific reference to the electrophotographic recording apparatus of the type shown in FIG. 13. The apparatus of FIG. 13, however, is only illustrative and the electrophotographic apparatus of the present invention can have various other forms, provided that the image transfer roller is brought into contact with the photosensitive member such as a drum or a belt in synchronization with or in relation to one of the basic operation signals such as the charging signal, exposure signal and developing signal. Therefore, in the case of an electrophotographic apparatus of FIG. 12 having a paper feed hopper, the movement of the image transfer roller into and out of contact with the photosensitive member maybe controlled in synchronization with or in relation to a signal for lifting or lowering the paper feed hopper. It is also possible to utilize a signal for starting or stopping the operation of the fixing roller as the time reference for the movement of the image transfer roller. For instance, the following conditions or moments of operation of the fixing unit 620 (see FIG. 13) can be used as the time reference for the control of movement of the image transfer roller: (1) the moment at which a pair of fixing rollers, i.e., a heat roller and a back-up roller, are put into pressure contact with each other; (2) the moment at which the supply of electrical power for heating to the fixing device is commenced; and (3) the moment at which the temperature of the heat roller has reached a predetermined level. Thus, the image transfer roller may be brought into pressure contact with the photosensitive drum in synchronization with any one of the conditions (1) to (3) mentioned above. The movement of the image transfer roller away from the photosensitive drum may be initiated in synchronization with the separation of the pair of fixing rollers which is conducted upon detection of jamming of the recording paper sheet or when the printing is finished.

In the embodiments and modifications described hereinbefore, the movement of the image transfer roller away from the photosensitive drum is initiated at a moment which is $\Delta t_2$ after the turning off of the developing signal. Obviously, however, timings of turning off with respect to other kinds of operation signals such as the charging signal and the exposure signal may be used. For instance, either of those two operation signals can be used as the time reference for initiating the movement of the image transfer roller away from the photosensitive drum. The movement of the image transfer roller into and out of contact with the photosensitive drum may be conducted cyclically for each of successive recording paper sheets. However, when the recording operation is conducted continuously on a plurality of consecutive recording paper sheets, the arrangement may be such that the image transfer roller is brought into pressure contact with the photosensitive drum in synchronization with the turning on of the charging signal for the first recording sheet and then moved away from the photosensitive drum in synchronization with the turning off of the developing signal for the final recording paper sheet. In such a case, the image transfer roller is kept in pressure contact with the photosensitive drum during recording of images on consecutive recording paper sheets.

Although the invention has been described with specific reference to a copying apparatus, the electrophotographic recording apparatus of the invention can be embodied in various other forms. Namely, the present invention can be applied to any type of recording or printing apparatus which employs electrophotographic process, such as a laser beam printer, a printer making use of an LED array or a liquid crystal array, and so forth. For instance, the invention can be applied to an electrophotographic recording apparatus incorporated in a PPC-FAX machine.

Figure 19:
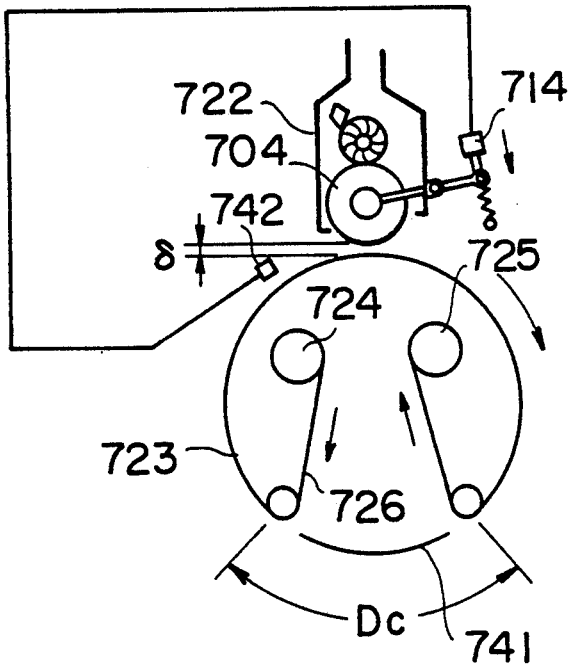
FIG. 19 is a schematic illustration of a modification of the apparatus shown in FIG. 13.

A further modification of the apparatus shown in FIG. 13 will be described with specific reference to FIG. 19. This modification employs a sheet-type photosensitive member 726 which is retained at its both ends by take-up rollers 724 and 725 and is wound on a photosensitive drum 723. An image transfer roll unit 722 has an image transfer roller 704 which is moved in response to basic operation signals of the electrophotographic apparatus as in the case of the apparatus shown in FIG. 13. After production of a predetermined number of copies, the take-up rollers 724 and 725 are suitably driven to bring a new portion of the photosensitive member 726 into operative position on the surface of the photosensitive drum 723. During taking up of the photosensitive sheet 726, a solenoid 714 is activated to keep the image transfer roller 704 away from the photosensitive sheet 726 by a distance $\delta$, so as to avoid trouble, such as damage on the surfaces of the photosensitive sheet 726 and the image transfer roller 704 and separation of photosensitive film from the photosensitive sheet 726.

It is possible to use a sensor 742 capable of detecting a region Dc including a capped portion 741 of the photosensitive drum 723 or a signal source indicative of the region Dc, thereby obtaining a signal indicating that the region Dc including the capped portion is in the image transfer section. In response to this signal, the solenoid 714 is energized to keep the image transfer roller 704 away from the photosensitive sheet 726 so that the image transfer roller 704 can clear any step or height change in the capped portion 741 of the photosensitive drum 723, thereby eliminating any risk for the image transfer roller to be damaged upon collision with such a step.

In the embodiments and modifications described hereinbefore, the image transfer roller is allowed to make pressure contact with the photosensitive member only when such a contact is necessary for the transfer of image, by a simple control which is conducted by making use of a timing signal which is derived from any suitable step of the electrophotographic process such as charging, exposure and development. It is therefore possible to eliminate any local deformation or damaging of the image transfer roller which may otherwise be caused when the image transfer roller is kept long in contact with the photosensitive roller under a pressure, thus contributing to improvement in the durability of the image transfer roller. In order to avoid troubles attributable to a slip of the image transfer roller, the image transfer roller may be power driven so as to ensure a good quality of the recording.

Although the invention has been described through specific forms, it is to be understood that the described embodiments and modifications are only illustrative and various changes and modifications may be imparted thereto without departing from the scope of the present invention which is limited solely by the appended claims.

What is claimed is:

1. An electrophotographic image transfer member comprising:

supporting means for pressing a recording medium into contact with a toner image;

an elastic member provided around said supporting means;

a conductive resin layer formed on the surface of said elastic member so as to be able to contact with said recording medium; and means for forming an electrical path for allowing supply of electricity to said conductive resin layer.

2. An electrophotographic image transfer member according to claim 1, wherein said supporting means includes a rotary member, and said image transfer member is a roller-type member having concentric layers including the layer of said elastic member on said rotary shaft and said conductive resin layer presenting the outermost layer.

3. An electrophotographic image transfer member according to claim 2, wherein said outermost layer is composed of a tube of a conductive resin.

4. An electrophotographic image transfer member according to claim 1, wherein said supporting means includes an elongated flat base member, and said image transfer member is a belt-type member having a layer of said elastic material on said base member and said conductive resin layer formed on said layer of said elastic member.

5. An electrophotographic image transfer member according to claim 1, wherein said image transfer member is a drum-type member for use in color electrophotographic printing.

6. An electrophotographic image transfer member according to claim 1, wherein said elastic member and said conductive resin layer are composed of a brush having a multiplicity of conductive resin bristles, and said means for forming an electrical path is provided by said conductive elastic bristles.

7. An electrophotographic image transfer member according to claim 6, wherein each of said bristles contains a magnetic component.

8. An electrophotographic image transfer member according to claim 6, wherein each bristle has a specific resistivity which ranges between $10^5$ and $10^{10}$ Ωcm.

9. An electrophotographic image transfer member according to claim 1, wherein said conductive resin layer is formed by dissolving or dispersing a conductive resin material in a solvent so as to form a solution and applying said solution to the surface of said elastic member.

10. An electrophotographic image transfer member according to claim 1, wherein said supporting means includes a conductive member, while said elastic member is formed of a conductive rubber, said conductive member of said supporting means and said elastic member formed of a conductive rubber together providing said means for providing an electrical path.

11. An electrophotographic image transfer member according to claim 1, wherein said said supporting means includes a conductive member, while said elastic member is formed of an insulating rubber rubber having at least partially a conductive portion, said conductive member of said supporting means and said conductive portion of said elastic member together providing said means for providing an electrical path.

12. An electrophotographic image transfer member according to claim 1, wherein said elastic member has a hardness ranging between 18 and 35 degrees in terms of rubber hardness as specified by JIS A.

13. An electrophotographic image transfer member according to claim 1, wherein said electrical path is formed through said supporting means and the electrical resistance between the surface of said conductive resin layer and said supporting means per unit area (1 $cm^2$) falls within the range between $1\times10^8$ and $5\times10^9$ Ω.

14. An electrophotographic image transfer member according to claim 13, wherein said image transfer member is used in combination with a photosensitive member which has a photosensitive layer of a thickness not greater than 30 μm.

15. An electrophotographic image transfer member according to claim 1, wherein said electrical path is formed through said elastic member and said conductive resin layer has a specific electric resistance not greater than a value which is 10 times as large as that of said elastic member.

16. An electrophotographic image transfer member according to claim 1, further comprising an additional resistor connected to said electrical path, said additional resistor having an electric resistance ranging between 5 and 100 MΩ.

17. An electrophotographic image transfer member according to claim 1, wherein said conductive resin layer is made of a material containing, at least, a fluororesin and a conductive substance.

18. An electrophotographic image transfer member according to claim 1, wherein said conductive resin layer is made of a material containing, at least, a nylon resin and a conductive substance.

19. An electrophotographic image transfer device comprising:

an image transfer member including, supporting means for pressing a recording medium into contact with a toner image, an elastic member provided around said supporting means, a conductive resin layer formed on the surface of said elastic member so as to be able to contact with said recording medium, and means for forming an electrical path for allowing supply of electricity to said conductive resin layer; and cleaning means capable of making frictional contact with said image transfer member so as to remove toner particles from said image transfer member.

20. An electrophotographic image transfer device according to claim 19, further comprising a discharge path for discharging electrostatic charges generated on the surface of said image transfer member.

21. An electrophotographic image transfer device according to claim 20, wherein a bias voltage is applied to said image transfer member through said electrical path, and wherein said discharge path is grounded through an electrical resistance which ranges between $10^8$ and $10^{11}$ Ω.

22. An electrophotographic image transfer device according to claim 19, wherein said supporting means includes a rotary member, and said image transfer member is a roller-type member having concentric layers including the layer of said elastic member on said rotary shaft and said conductive resin layer as the outermost layer.

23. An electrophotographic image transfer device according to claim 19, wherein said supporting means includes an elongated flat base member, and said image transfer member is a belt-type member having a layer of said elastic material on said base member and said conductive resin layer formed on said layer of said elastic member.

24. An electrophotographic image transfer device according to claim 19, wherein said elastic member and said conductive resin layer are composed of a brush having a multiplicity of conductive resin bristles, and said means for forming an electrical path is provided by said conductive elastic bristles.

25. An electrophotographic image transfer device according to claim 20, further comprising a bias power supply which is connected to the electrical path of said image transfer member, said discharge path being formed through said bias power supply.

26. An electrophotographic image transfer device according to claim 20, further comprising a bias power supply which is connected to the electrical path of said image transfer member, said discharge path being connected to said electrical path in parallel with said bias power supply.

27. An electrophotographic image transfer device according to claim 20, wherein said cleaning means includes a conductive member and said discharge path is formed through said conductive member of said cleaning means.

28. An electrophotographic image transfer device according to claim 20, wherein said bias voltage is applied to said image transfer member through said electrical path during transference of an image, while said discharge path is connected to said image transfer member when the transfer of an image is not being conducted.

29. An electrophotographic image transfer device according to claim 19, wherein said cleaning mean includes means for pneumatically conveying the toner removed from said image transfer member.

30. An electrophotographic image transfer device according to claim 19, wherein said cleaning means includes a collector roll for conveying the toner removed from said image transfer member and wherein a bias voltage is applied to said collector roll.

31. An electrophotographic image transfer device according to claim 30, wherein said collector roller has a surface roughened to have fine convexities and concavities of 10 to 100 μm in depth.

32. An electrophotographic image transfer device according to claim 30, wherein said collector roll has a plurality of magnets disposed therein.

33. An electrophotographic recording apparatus of the type in which a recording medium is brought into contact with an image formed on a photosensitive member and developed by a toner and a bias voltage is applied to enable the toner image to be transferred from said photosensitive member to a recording medium, said electrophotographic recording apparatus comprising:

an image transfer member for causing said recording medium to be pressed onto said photosensitive member and for applying the bias voltage; and actuating means for moving said image transfer member towards and away from said photosensitive member in response to one of a plurality of operation signals produced, each corresponding to one of the operation steps of an electrophotographic process starting with operation of a hopper for supplying said recording medium or starting of charging and ending in fixing of the transferred image.

34. An electrophotographic recording apparatus according to claim 33, wherein said actuating means operates to move said image transfer member towards said photosensitive member when a predetermined time has elapsed after issue of a signal for starting said one of said operation steps.

35. An electrophotographic recording apparatus according to claim 33, wherein said actuating means operates to move said image transfer member away from said photosensitive member when a predetermined time has elapsed after issue of a signal for ending said one of said operation steps or when a signal is issued for separating fixing rollers from each other.

36. An electrophotographic recording apparatus according to claim 33, wherein said image transfer member is mounted rotatably and is provided with a driving power source movable together with said image transfer member and capable of rotatingly driving said image transfer member.

37. An electrophotographic recording apparatus according to claim 33, wherein said photosensitive member is a continuous sheet-type member which is taken up as desired by a take-up device, and wherein said actuating means operates to move said image transfer member away from said photosensitive member also when said photosensitive member is taken up by said take-up means.

38. An electrophotographic recording apparatus according to claim 33, wherein said photosensitive member is a continuous sheet-type member which is taken up as desired by a take-up device, and wherein said actuating means operates to move said image transfer member away from said photosensitive member also when a predetermined region, including a capped portion of said sheet-type photosensitive member, is in the image transfer position.

* * * * *

UNITED STATES PATENT AND TRADEMARK OFFICE

CERTIFICATE OF CORRECTION

PATENT NO. : 4,998,143

DATED : March 5, 1991

INVENTOR(S) : Takao Kumasaka et al

It is certified that error appears in the above-identified patent and that said Letters Patent is hereby corrected as shown below:

| Column | Line | |
|---|---|---|
| 1 | 25 | After "a roller" insert --,--. |
| 1 | 26 | After "medium" insert --,--. |
| 1 | 33 | Before "US" delete "the". |
| 2 | 10 | Change "a image" to --an image--. |
| 3 | 56 | After "accordance" change "that" to --with--. |
| 3 | 57 | Change "which" to --that--. |
| 4 | 11 | After "preferred" insert --embodiments--. |
| 4 | 44 | Delete "and". |
| 4 | 58 | After "position" insert --.--. |
| 5 | 28 | Change "exhibits" to --exhibit,--. |
| 6 | 29 | Change "...$(R_G/R_G)$" to --...$(R_G/l_G)$--. |
| 6 | 32 | Change "$R_S$ = ps.$l_S$" to --$R_S = P_S \cdot l_S$--; |
| | | change "$R_G$ = pG.lG" to --$R_G = P_G \cdot l_G$--. |
| 6 | 36 | Change "ps $\leq$ 10 x $P_G$" to --$P_S \leq 10 \times P_G$--. |
| 7 | 25 | Change "!8" to --18--. |
| 7 | 57 | Change "maybe" to --may be --. |
| 8 | 67 | Change "role:" to --roles:--. |
| 10 | 50 | Change "convey" to --conveyance--. |

UNITED STATES PATENT AND TRADEMARK OFFICE

CERTIFICATE OF CORRECTION

PATENT NO. : 4,998,143

DATED : March 5, 1991

INVENTOR(S) : Takao Kumasaka et al

It is certified that error appears in the above-identified patent and that said Letters Patent is hereby corrected as shown below:

| Column | Line | |
|---|---|---|
| 11 | 16 | Change "electrophotoqraphic" to --electrophotographic--. |
| 12 | 1 | Change "to be" to --is--. |
| 12 | 23 | Change "1000 V" to --1000V--. |
| 12 | 25 | Delete "to". |
| 12 | 28 | After "plunger" insert --,--. |
| 12 | 40 | Delete "and the", second occurrence. |
| 12 | 50 | Before "charging" delete "the". |
| 13 | 18 | After "time" delete "elapses". |
| 13 | 54 | Change "image transfer roller" to --photosensitive drum--. |
| 14 | 9 | Change "maybe" to --may be--. |
| 15 | 2 | Change "maybe" to --may be--. |
| 17 | 46 | Delete "rubber" second occurrence. |
| 18 | 3 | Change "10" to --10--. |

UNITED STATES PATENT AND TRADEMARK OFFICE

CERTIFICATE OF CORRECTION

PATENT NO. : 4,998,143

DATED : March 5, 1991

INVENTOR(S) : Takao Kumasaka et al

It is certified that error appears in the above-identified patent and that said Letters Patent is hereby corrected as shown below:

| Column | Line | |
|---|---|---|
| 19 | 18 | Change "mean" to --means--. |

Signed and Sealed this

Sixth Day of October, 1992

*Attest:*

DOUGLAS B. COMER

*Attesting Officer*

*Acting Commissioner of Patents and Trademarks*